US010944192B2

(12) United States Patent
Zhong et al.

(10) Patent No.: US 10,944,192 B2
(45) Date of Patent: Mar. 9, 2021

(54) ELECTRICAL CONNECTOR

(71) Applicant: LOTES CO., LTD, Keelung (TW)

(72) Inventors: Wei Xue Zhong, Keelung (TW); Biao Zhang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/695,479

(22) Filed: Nov. 26, 2019

(65) Prior Publication Data

US 2020/0176904 A1 Jun. 4, 2020

(30) Foreign Application Priority Data

Dec. 3, 2018 (CN) ..... 201811465454.0

(51) Int. Cl.
*H01R 12/72* (2011.01)
*H01R 13/627* (2006.01)
*H01R 13/641* (2006.01)

(52) U.S. Cl.
CPC ..... *H01R 12/721* (2013.01); *H01R 13/6273* (2013.01); *H01R 13/641* (2013.01)

(58) Field of Classification Search
CPC . H01R 12/721; H01R 13/6273; H01R 13/641
USPC ..... 439/59
See application file for complete search history.

(56) References Cited

U.S. PATENT DOCUMENTS 6,866,544 B1 * 3/2005 Casey ..... H05K 9/0058 439/607.2
7,583,510 B2 * 9/2009 Wang ..... H01R 13/6593 361/753
8,469,744 B2 * 6/2013 Nichols ..... H01R 13/659 439/607.01
8,613,632 B1 * 12/2013 Nichols ..... H01R 13/6587 439/607.21
8,890,004 B2 * 11/2014 Wickes ..... H05K 9/0009 174/382
9,402,332 B2 * 7/2016 McKervey ..... H05K 7/20409
9,532,486 B1 * 12/2016 Hinkle ..... H01R 12/721
10,062,991 B2 * 8/2018 Wang ..... H01R 12/721
10,178,804 B2 * 1/2019 Sharf ..... H01R 12/70
(Continued)

FOREIGN PATENT DOCUMENTS

CN 202660350 U 1/2013
CN 103107446 A 5/2013
CN 207269067 U 4/2018

*Primary Examiner* — Alexander Gilman
(74) *Attorney, Agent, or Firm* — Locke Lord LLP; Tim Tingkang Xia, Esq.

(57) ABSTRACT

An electrical connector is used to be electrically connected to a mating component. The electrical connector includes a body having an insertion slot for the mating component to insert therein along a mating direction, and two side walls located at two opposite sides of the insertion slot and extending along an elongated direction perpendicular to the mating direction. A retainer is provided at one end of the body along the elongated direction to buckle with the mating component. Multiple terminals are provided on the two side walls, protruding into the insertion slot to mate with the mating component. A metal member is provided on the body and correspondingly covering one of the side walls. The metal member is provided with at least one through slot provided obliquely relative to the mating direction and adjacent to the retainer in the elongated direction.

20 Claims, 14 Drawing Sheets

(56) References Cited

U.S. PATENT DOCUMENTS

| | | | | |
|---|---|---|---|---|
| 10,707,601 | B1 * | 7/2020 | Lai | G06F 1/183 |
| 10,734,741 | B2 * | 8/2020 | Yukutake | H01R 13/6587 |
| 2005/0277334 | A1 * | 12/2005 | Huang | H01R 23/6873 439/607.01 |
| 2014/0170875 | A1 * | 6/2014 | Shen | H01R 12/721 439/159 |
| 2015/0188246 | A1 * | 7/2015 | Chen | G06K 7/0056 439/377 |
| 2016/0013589 | A1 * | 1/2016 | Fu | H01R 12/7005 439/157 |
| 2020/0176904 | A1 * | 6/2020 | Zhong | H01R 12/737 |

* cited by examiner

A-A

B-B

C–C

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201811465454.0 filed in China on Dec. 3, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to a Peripheral Component Interconnect Express (PCI-E) electrical connector used for insertion of an electronic card.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Currently, the industry provides an electrical connector, which is used for insertion of an electronic card. The electrical connector includes: an insulating body, multiple terminals accommodated in the insulating body, a metal member provided on the insulating body, and a retainer provided at an elongated end of the insulating body. The insulating body includes two side walls extending along an elongated direction thereof, and two end walls connecting the two side walls, and the two side walls and the two end walls surroundingly form an insertion slot, which is used for the electronic card to insert therein along a mating direction. The metal member covers the insulating body to strengthen the strength of the insulating body. The metal member is provided with multiple through slots corresponding to each of the side walls, and the through slots are in parallel to or perpendicular to the mating direction to dissipate the heat generated by the electrical connector during usage.

However, the through slots are provided in parallel to or perpendicular to the mating direction, such that the length of the through slots parallel to or perpendicular to the mating direction is too long, resulting in the through slots reducing the strength of the metal member to an excessive degree, and causing the metal member to have great deformation in the process of forming the through slots, which is not in favor of the metal member being provided on the insulating body.

Further, since the through slots are provided in parallel to or perpendicular to the mating direction, the heat generated by the electrical connector during usage is dissipated only in a single direction, thereby affecting the normal usage of the electrical connector due to untimely heat dissipation thereof.

Therefore, a heretofore unaddressed need to design a new electrical connector exists in the art to address the aforementioned deficiencies and inadequacies.

SUMMARY

The present invention is directed to an electrical connector, which is convenient to provide a metal member on the body, and the metal member has a better heat dissipation effect.

To achieve the foregoing objective, the electrical connector according to certain embodiments of the present invention adopts the following technical solutions.

An electrical connector is configured to mate with a mating component. The electrical connector includes: a body, having an insertion slot and two side walls located at two opposite sides of the insertion slot, wherein the insertion slot is configured for the mating component to insert therein along a mating direction, and the two side walls extend along an elongated direction perpendicular to the mating direction; a retainer, provided at one end of the body along the elongated direction, and configured to buckle with the mating component; a plurality of terminals, provided on the two side walls and protruding into the insertion slot to mate with the mating component; and a metal member, provided on the body and correspondingly covering one of the side walls, wherein the metal member is provided with at least one through slot provided obliquely relative to the mating direction and adjacent to the retainer in the elongated direction.

In certain embodiments, the insertion slot is concavely provided on a top surface of the body, the mating direction is a downward direction, each of the at least one through slot has a first edge being inclined, and an upper end of the first edge is located closer to the retainer in the elongated direction relative to a lower end of the first edge.

In certain embodiments, a lower end of each of the side walls is located farther away from the at least one through slot than an upper end of each of the side walls.

In certain embodiments, each of the at least one through slot has two first edges opposite to each other and a second edge connecting the two first edges, the two first edges are in parallel to each other, and the second edge is in parallel to the elongated direction.

In certain embodiments, the terminals being provided on each of the side walls are arranged in a row along the elongated direction, and an extending length of each of the at least one through slot in the elongated direction crosses over at least two of the terminals being successively arranged.

In certain embodiments, the body is provided with a key portion connecting the two side walls along a lateral direction perpendicular to the mating direction and the elongated direction, and the metal member is provided with at least three through slots located between the retainer and the key portion in the elongated direction.

In certain embodiments, the metal member is provided with at least two through slots, the body further has an end wall, the end wall is connected to an end of each of the two side walls along the elongated direction and is located closer to the retainer in the elongated direction relative to the at least two through slots, the metal member comprises two main body portions opposite to each other and a connecting portion connecting the two main body portions, the two main body portions respectively cover the two side walls, the connecting portion correspondingly covers the end wall, and each of the main body portions is provided with at least one of the at least two through slots.

An electrical connector is configured to mate with a mating component. The electrical connector includes: a body, having a top surface, an insertion slot extending along an elongated direction and downward concavely provided on the top surface thereof, and two side walls located at two opposite sides of the insertion slot, wherein the insertion slot is configured for the mating component to insert downward therein, the insertion slot defines a virtual center line extending along a vertical direction, and the two side walls extend along the elongated direction; only one retainer, provided at one end of the body along the elongated direction, and configured to buckle with the mating component; a plurality of terminals, provided on the body and protruding into the insertion slot to mate with the mating component; and a metal member, provided on the body and correspondingly covering a corresponding one of the side walls, wherein the metal member is provided with at least one through slot provided obliquely in the elongated direction and adjacent to the retainer relative to the virtual center line.

In certain embodiments, each of the at least one through slot has a first edge being inclined, and an upper end of the first edge is located closer to the retainer in the elongated direction relative to a lower end of the first edge.

In certain embodiments, the terminals are respectively provided on the two side walls, the terminals being provided on each of the side walls are arranged in a row along the elongated direction, and an extending length of each of the at least one through slot in the elongated direction crosses over at least two of the terminals being successively arranged.

In certain embodiments, the metal member is provided with at least three through slots located between the virtual center line and the retainer in the elongated direction.

In certain embodiments, a tail end of the insertion slot along the elongated direction has an inner wall connecting the two side walls, the at least one through slot is located between the virtual center line and the inner wall in the elongated direction, and along the elongated direction, a distance between one of the at least one through slot and the inner wall is less than a distance between the one of the at least one through slot and the virtual center line.

In certain embodiments, a lower end of each of the side walls is located farther away from the at least one through slot than an upper end of each of the side walls.

In certain embodiments, the metal member has a mounting leg extending downward and pass beyond the corresponding one of the side walls to be soldered to a circuit board, and the mounting leg is located between the at least one through slot and the retainer in the elongated direction.

In certain embodiments, the body comprises a concave slot and a receiving slot downward concavely provided on a top surface of the corresponding one of the side walls, the concave slot runs outward through the corresponding one of the side walls, the concave slot has a first wall, a second wall, and a third wall connecting the first wall and the second wall, the receiving slot runs through the first wall, the second wall and the third wall respectively, the receiving slot does not run outward through the corresponding one of the side walls, the metal member is accommodated in the receiving slot and fixed and matched with the receiving slot, and the at least one through slot is exposed to the concave slot.

In certain embodiments, the electrical connector further includes a reinforcing member provided on the body, wherein the body is provided with a key portion connecting the two side walls along a lateral direction perpendicular to the vertical direction and the elongated direction, and the reinforcing member covers a top surface of the key portion.

In certain embodiments, the body further comprises two end portions respectively connected to two elongated ends of the two side walls, the reinforcing member is fixed and matched with one of the two end portions, and the metal member is fixed and matched with the other of the two end portions.

An electrical connector is configured to mate with a mating component. The electrical connector includes: an insulating body, having two side walls opposite to each other and an insertion slot formed between inner sides of the two side walls, wherein the insertion slot is configured for the mating component to insert therein along a mating direction; a plurality of terminals, provided on the two side walls and protruding into the insertion slot to mate with the mating component; and a metal member, provided on the insulating body and at least covering an outer side of one of the side walls, wherein the outer side and the inner side of each of the side walls are opposite to each other, the metal member is provided with a through slot to dissipate heat, the through slot is provided obliquely relative to the mating direction, and a surface of each of the side walls does not enter the through slot.

In certain embodiments, the insertion slot extends along an elongated direction perpendicular to the mating direction, the insertion slot defines a virtual center line in parallel to the mating direction, the two side walls extend along the elongated direction, a tail end of the insertion slot along the elongated direction has an inner wall connecting the two side walls, the through slot is located between the virtual center line and the inner wall in the elongated direction, and along the elongated direction, a distance between the through slot and the inner wall is less than a distance between the through slot and the virtual center line.

In certain embodiments, the electrical connector further includes a reinforcing member, wherein the insertion slot is concavely provided on a top surface of the insulating body, the mating direction is a downward direction, the insulating body is provided with a key portion connecting the two side walls along a lateral direction perpendicular to the mating direction and the elongated direction, and the reinforcing member covers the outer sides of the two side walls and covers a top surface of the key portion.

Compared with the related art, the electrical connector according to certain embodiments of the present invention have the following beneficial effects.

In comparison with the through slot structure commonly used in the industry, i.e., the through slot structure provided in parallel to or perpendicular to the mating direction, and with the premise that the quantity and area of the through slots are the same, the through slots being provided obliquely may effectively reduce the length of the through slot parallel to or perpendicular to the mating direction, such that the metal member maintains a stronger strength and does not easily deform, facilitating the metal member to be provided on the body. Further, since the through slots are provided obliquely, in the process of heat dissipating through the oblique through slots, the flow disturbing effect may easily occur, and the heat is diffused outward, such that the heat dissipation speed and flow rate significantly increase, facilitating timely heat dissipation and ensuring the normal use of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
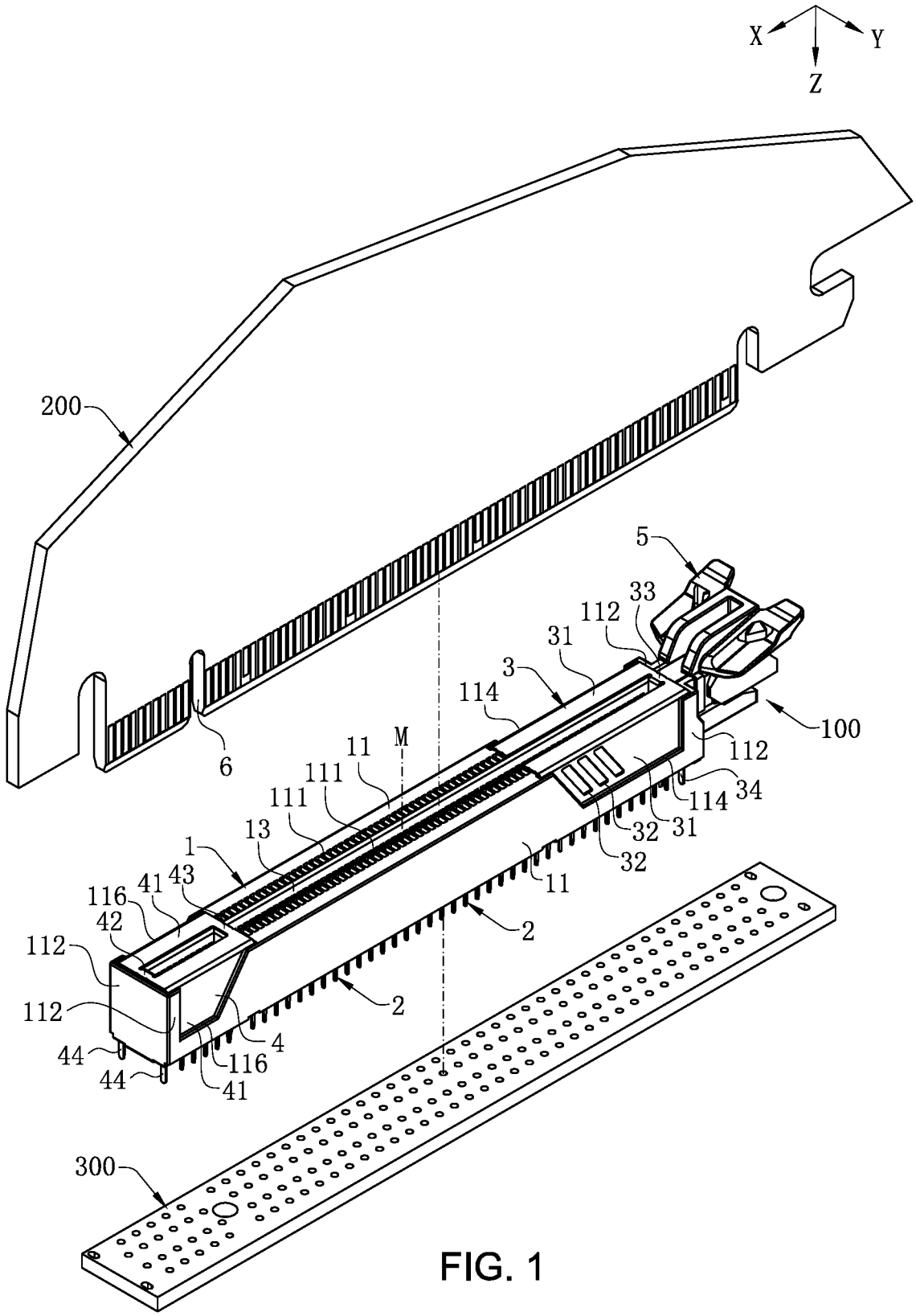
FIG. 1 is a perspective view of an electrical connector, a mating component and an electrical component according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-14. In accordance with the purposes of this invention, as embodied and broadly described herein, this invention, in one aspect, relates to an electrical connector.

The electrical connector 100 according to certain embodiments of the present invention defines a mating direction Z, and an elongated direction X and a lateral direction Y perpendicular to the mating direction Z and perpendicular to each other.

FIG. 1 shows an electrical connector 100 according to a first embodiment of the present invention, which is used to conductively connect a mating component 200 to an electrical component 300. The electrical connector 100 includes a body 1, a plurality of terminals 2 accommodated in the body 1, a metal member 3 and a reinforcing member 4 mounted on the body 1, and a retainer 5 mounted at a rear end of the body 1. In this embodiment, the electrical connector 100 is a Peripheral Component Interconnect Express (PCI-E) electrical connector, and the retainer 5 is only provided at one end of the body 1 along the X-axis direction (referring to FIG. 1). The retainer 5 is used to buckle with the mating component 200. The mating component 200 is an electronic card, and the electrical component 300 is a circuit board. In other embodiments, the electrical connector 100 can be other types of connectors, and the mating component 200 and the electrical component 300 can correspondingly adopt other types of components.

Figure 2:
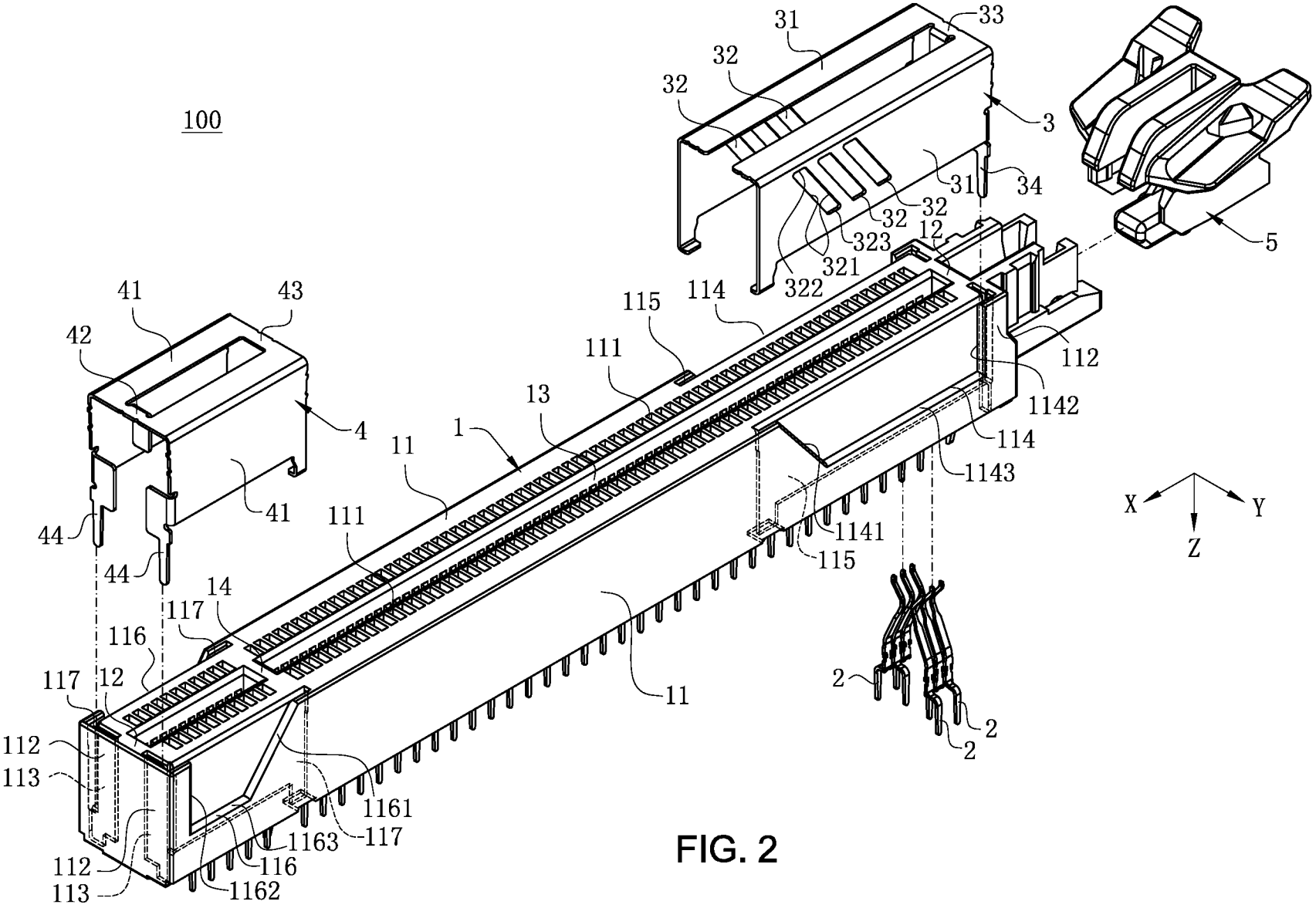
FIG. 2 is a perspective exploded view of the electrical connector in FIG. 1.
Figure 3:
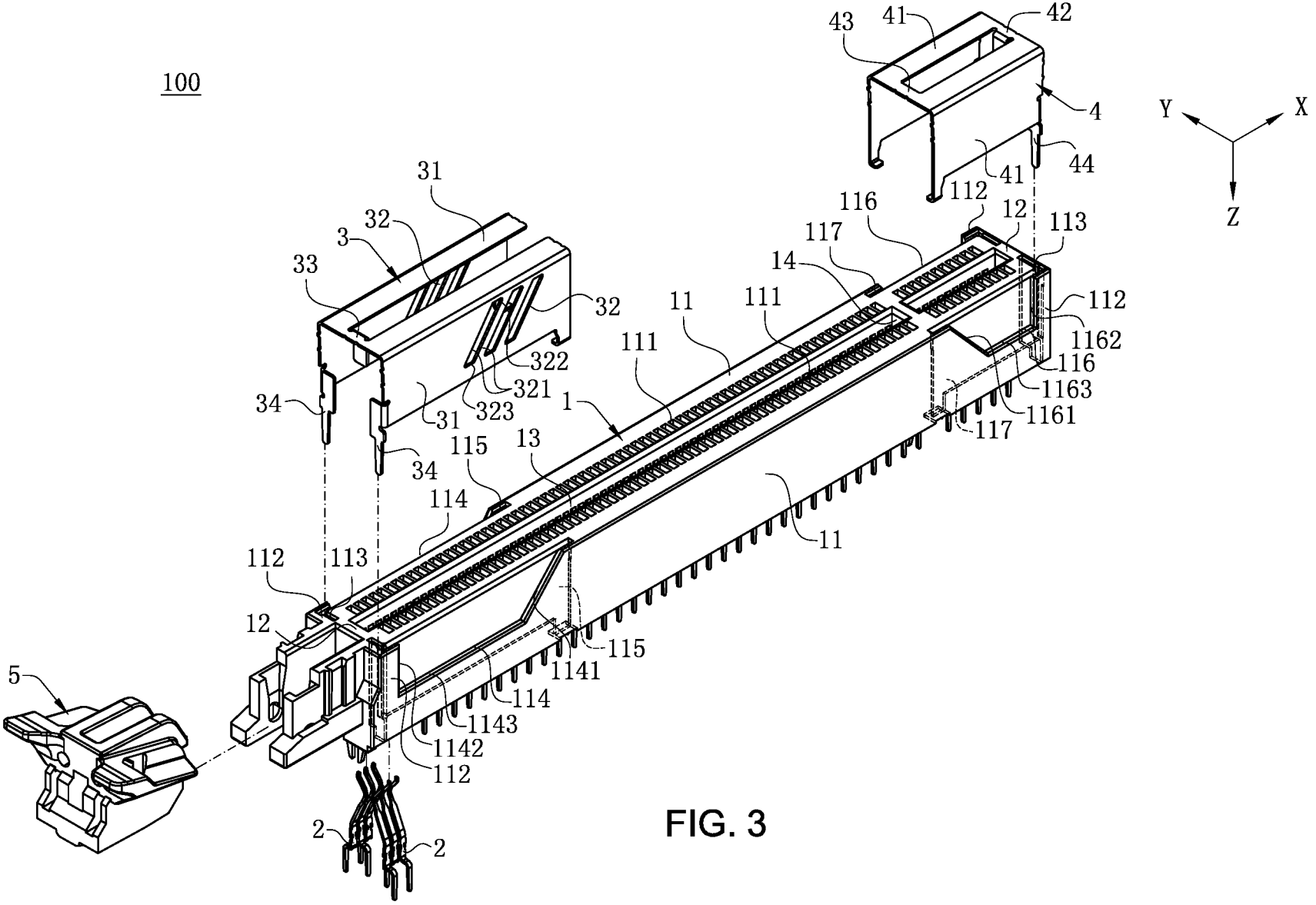
FIG. 3 is a perspective exploded view of the electrical connector in FIG. 2 being 180° inversed.

As shown in FIG. 1, FIG. 2 and FIG. 3, the body 1 is made of an insulating material. The body 1 includes two side walls 11, two end walls 12 connecting the two side walls 11, and an insertion slot 13 surroundingly formed by the two side walls 11 and the two end walls 12. The two side walls 11 are provided to extend along the X direction and are symmetrically provided relative to the insertion slot 13, and the two end walls 12 are provided to extend along the Y direction and are symmetrically provided relative to the insertion slot 13. The insertion slot 13 is downward concavely provided on a top surface of the body 1, and the insertion slot 13 is formed between the inner sides of the two side walls 11 (referring to FIG. 2). The insertion slot 13 is used for the mating component 200 to insert downward therein along the Z direction. The insertion slot 13 defines a virtual center line M, which is in parallel to the Z direction.

As shown in FIG. 1, FIG. 2 and FIG. 3, the body 1 further includes a key portion 14 connecting the two side walls 11 in the Y direction. The key portion 14 is provided in the insertion slot 13 and located between the two end walls 12. The mating component 200 has a notch 6 to match with the key portion 14.

Figure 6:
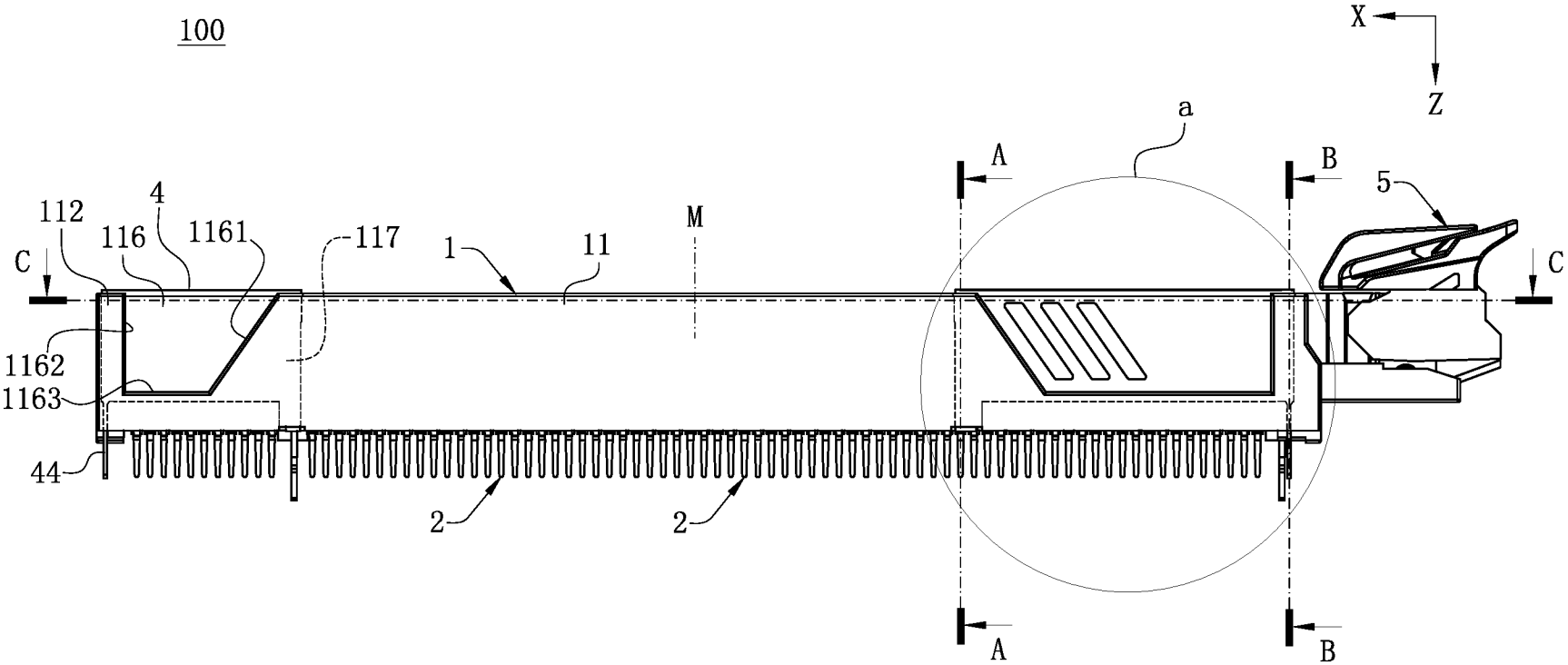
FIG. 6 is a side view of the electrical connector in FIG. 1.
Figure 7:
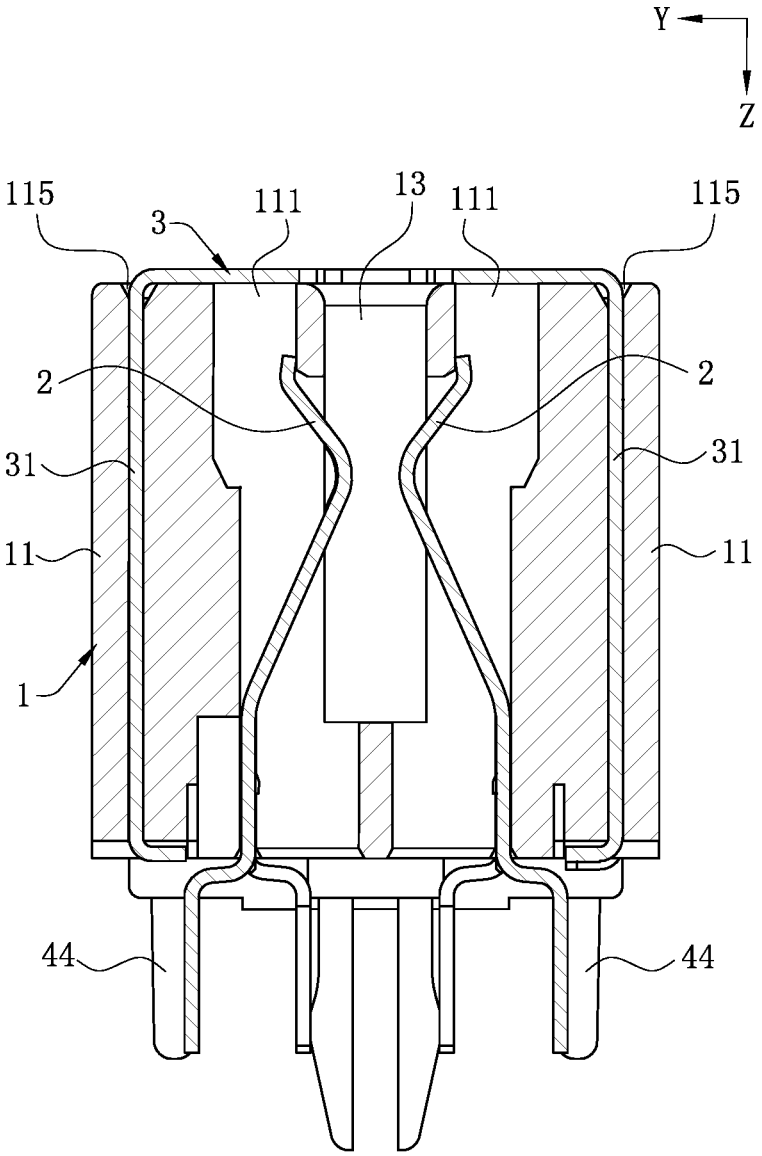
FIG. 7 is a sectional view of the electrical connector in FIG. 6 along the A-A direction.

As shown in FIG. 1, FIG. 6 and FIG. 7, each of the side walls 11 is provided with multiple terminal holes 111 in communication with the insertion slot 13 in the Y direction, and the terminal holes 111 being provided on the same side wall 11 are arranged in a row in the X direction.

Figure 8:
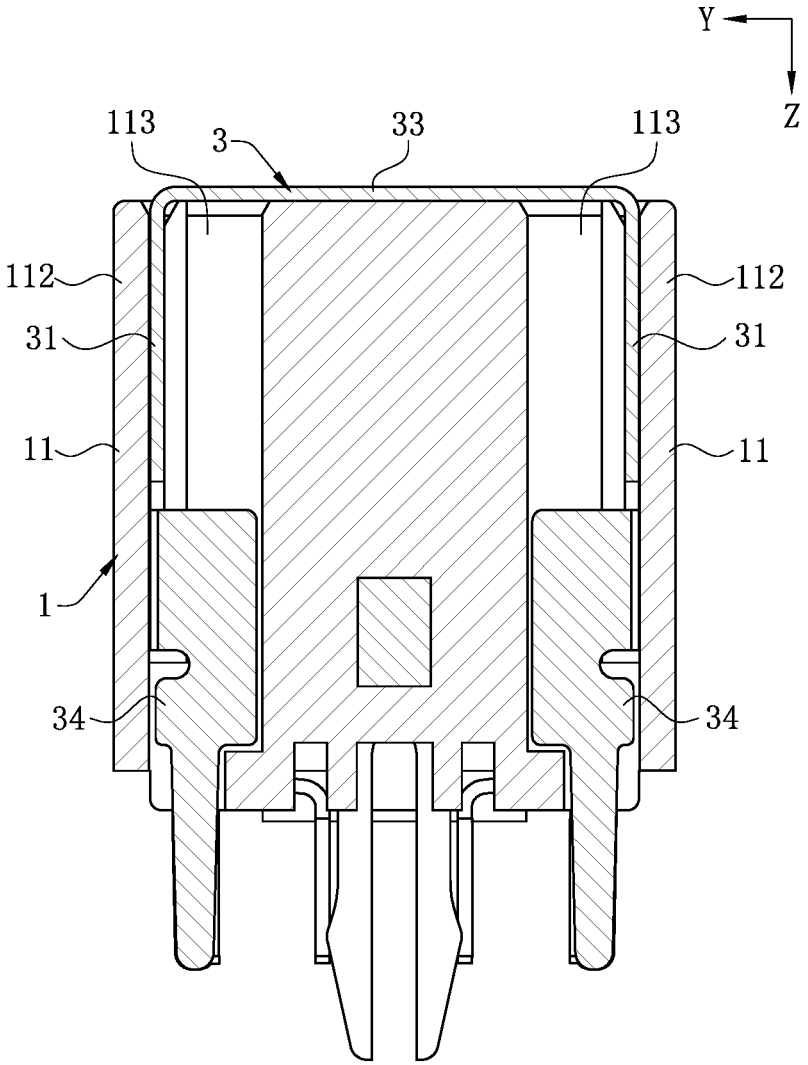
FIG. 8 is a sectional view of the electrical connector in FIG. 6 along the B-B direction.

As shown in FIG. 2, FIG. 6 and FIG. 8, each of the side walls 11 has two end portions 112 located at two elongated ends thereof and two embedded slots 113, and each embedded slot 113 is concavely provided on a top surface of each end portion 112 correspondingly. The two end portions 112 are provided to correspond to the two end walls 12 in the Y direction, and the embedded slots 113 run downward through the end portions 112 correspondingly.

Figure 4:
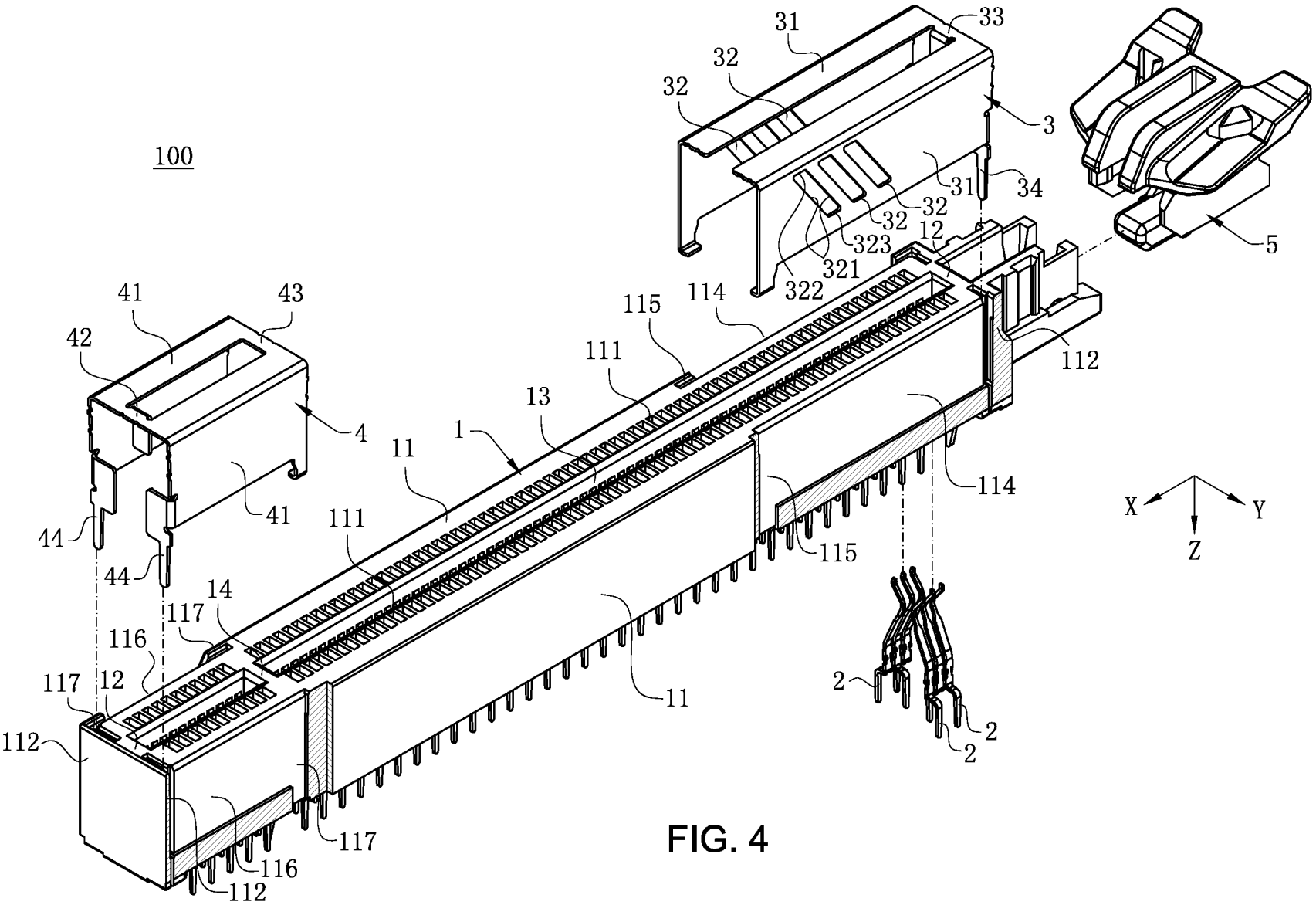
FIG. 4 is a perspective sectional view of the electrical connector in FIG. 1.

As shown in FIG. 2, FIG. 3 and FIG. 4, the body 1 includes a concave slot 114 and a receiving slot 115 downward concavely provided on a top surface of each of the side walls 11. The concave slot 114 and the receiving slot 115 are in communication with each other.

Figure 10:
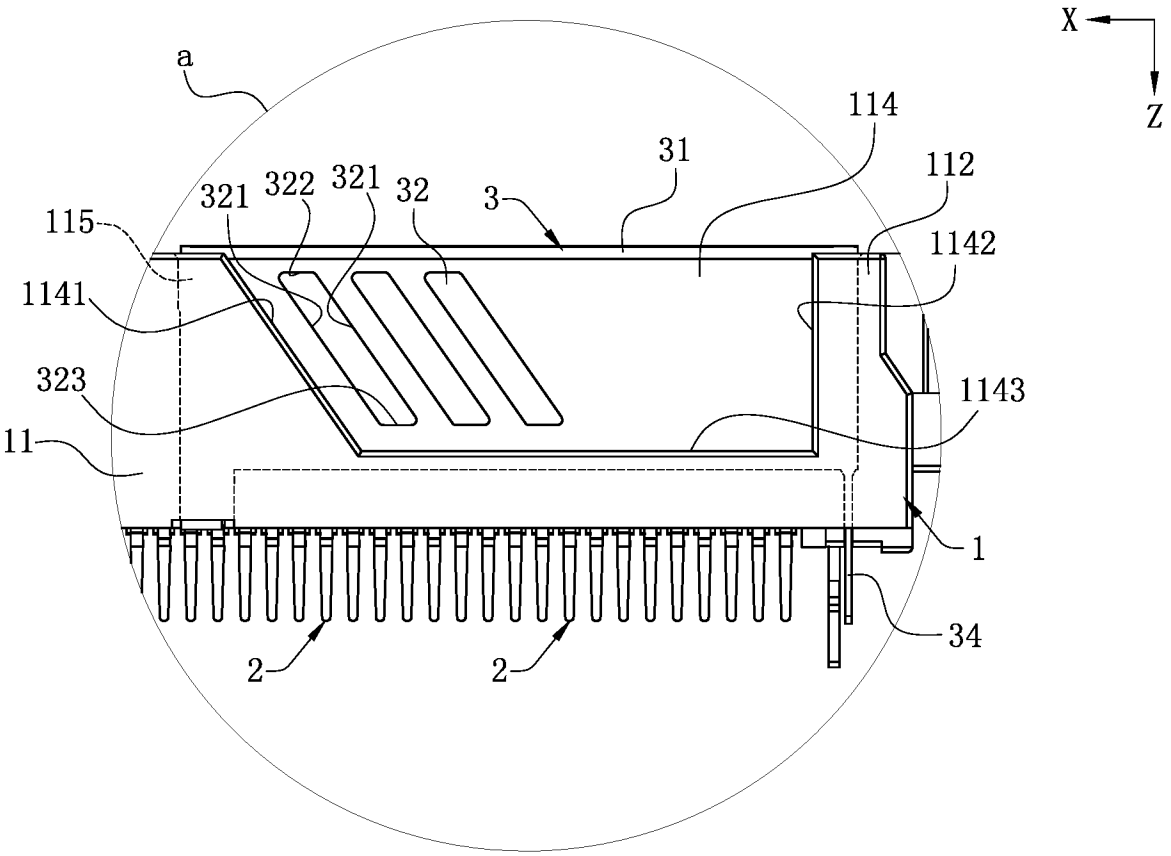
FIG. 10 is an enlarged view of a part a of the electrical connector in FIG. 6.
Figure 11:
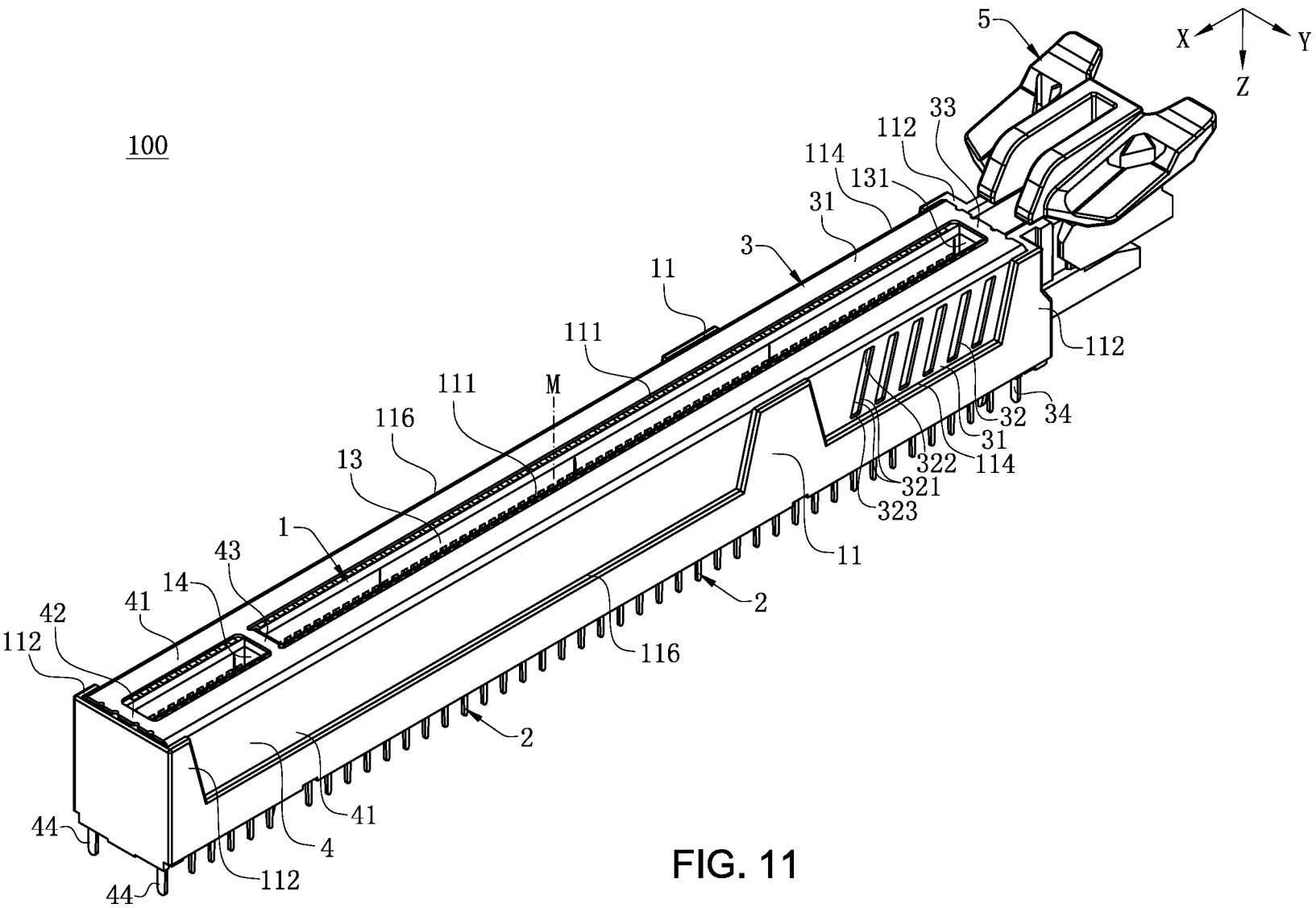
FIG. 11 is a perspective assembled view of an electrical connector according to a second embodiment of the present invention.
Figure 12:
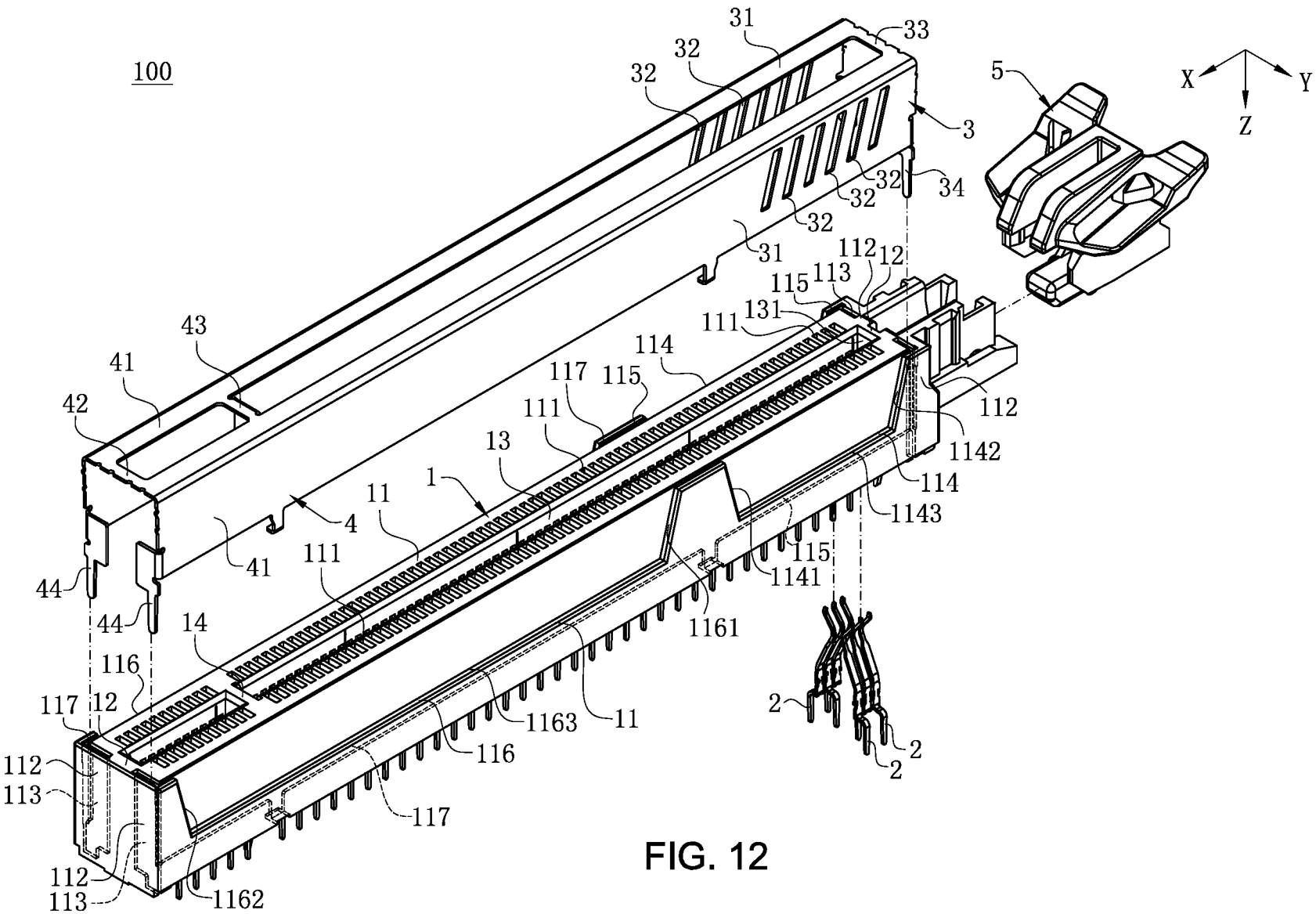
FIG. 12 is a perspective exploded view of the electrical connector in FIG. 11.
Figure 13:
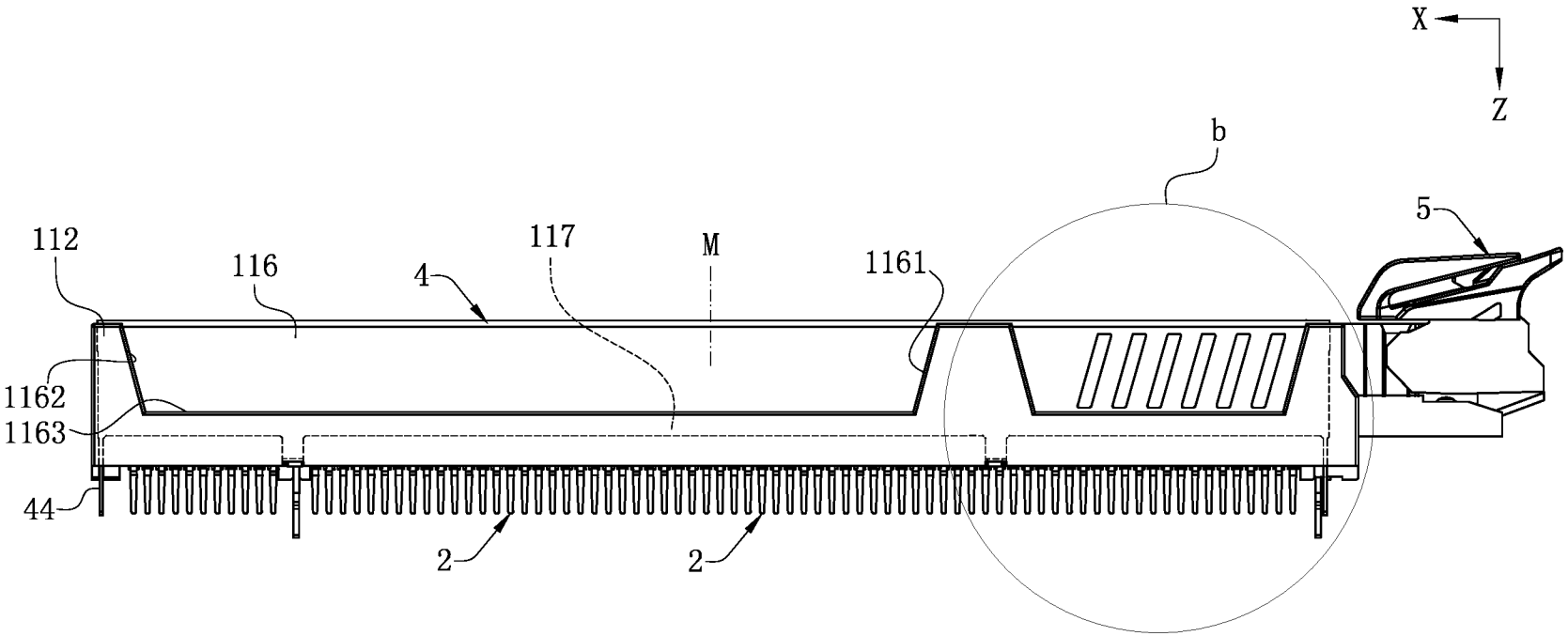
FIG. 13 is a side view of the electrical connector in FIG. 11.
Figure 14:
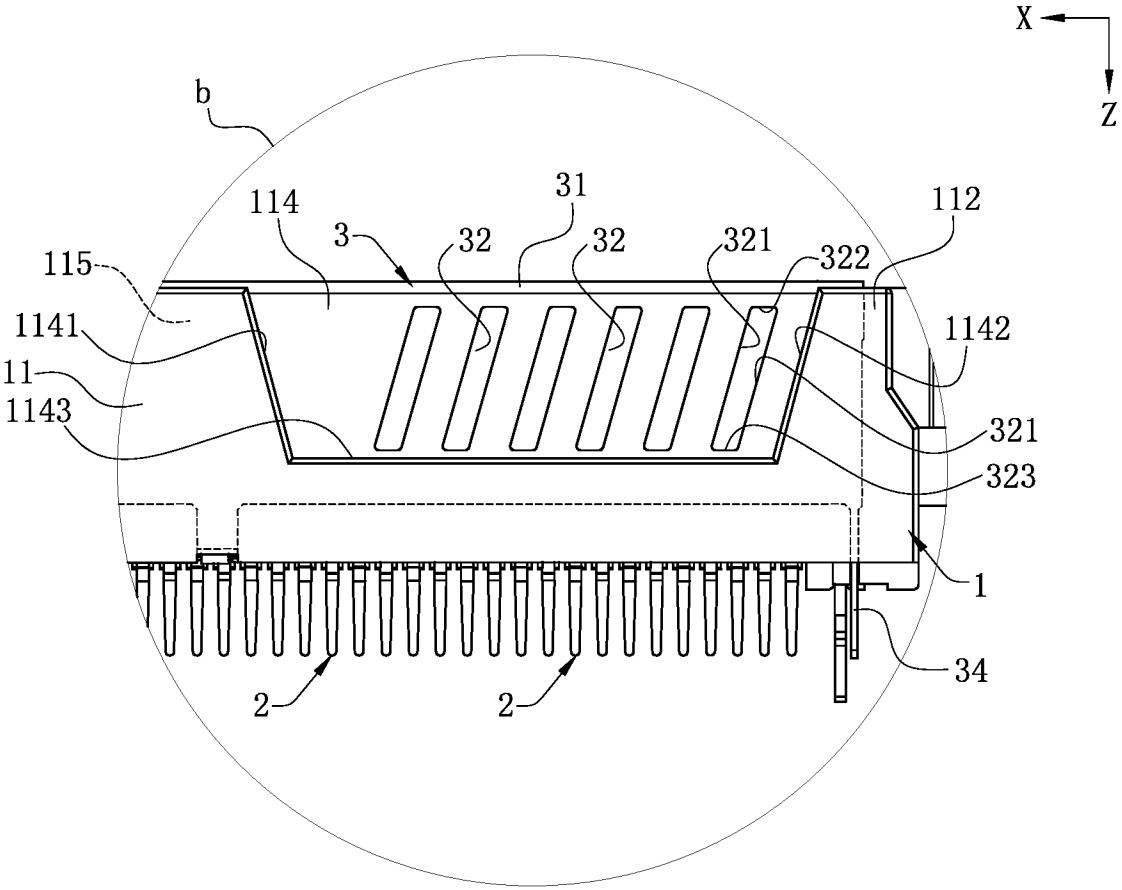
FIG. 14 is an enlarged view of a part b of the electrical connector in FIG. 13.

As shown in FIG. 2, FIG. 6 and FIG. 10, the concave slot 114 runs outward through the corresponding side wall 11, and does not run downward through the corresponding side wall 11. The concave slot 114 has a first wall 1141, a second wall 1142, and a third wall 1143 connecting the first wall 1141 and the second wall 1142. The first wall 1141 and the second wall 1142 are located at two opposite ends of the concave slot 114, and the second wall 1142 is located closer to the retainer 5 and farther away from the reinforcing member 4 relative to the first wall 1141. The first wall 1141 is provided obliquely relative to the Z direction. The second wall 1142 is provided obliquely relative to the first wall 1141, and the second wall 1142 is in parallel to the Z direction. The third wall 1143 is perpendicular to the Z direction.

As shown in FIG. 2, FIG. 6 and FIG. 10, the receiving slot 115 runs downward through the first wall 1141, the second wall 1142 and the third wall 1143, and does not run downward or outward through the corresponding side wall 11. The receiving slot 115 runs backward through a portion of the corresponding end portion 112 along the X direction, and is in communication with the corresponding embedded slot 113.

As shown in FIG. 2, FIG. 3 and FIG. 6, the body 1 further includes a recess 116 and an accommodating slot 117 downward concavely provided on the top surface of each of the side walls 11. The recess 116 and the accommodating slot 117 are in communication with each other, and the recess 116 is located farther away from the retainer 5 relative to the concave slot 114 in the X direction.

As shown in FIG. 2 and FIG. 6, the recess 116 runs upward through the corresponding side wall 11 and does not run downward through the corresponding side wall 11. The recess 116 has a first surface 1161, a second surface 1162, and a third surface 1163 connecting the first surface 1161 and the second surface 1162. The first surface 1161 and the second surface 1162 are located at two opposite ends of the recess 116, and the first surface 1161 is located between the second surface 1162 and the first wall 1141. The first surface 1161 is provided obliquely relative to the Z direction, and the first surface 1161 is provided obliquely relative to the first wall 1141. The second surface 1162 is provided obliquely relative to the first surface 1161, and the second surface 1162 is in parallel to the second wall 1142. The third surface 1163 and the third wall 1143 are located on a same horizontal plane.

Figure 9:
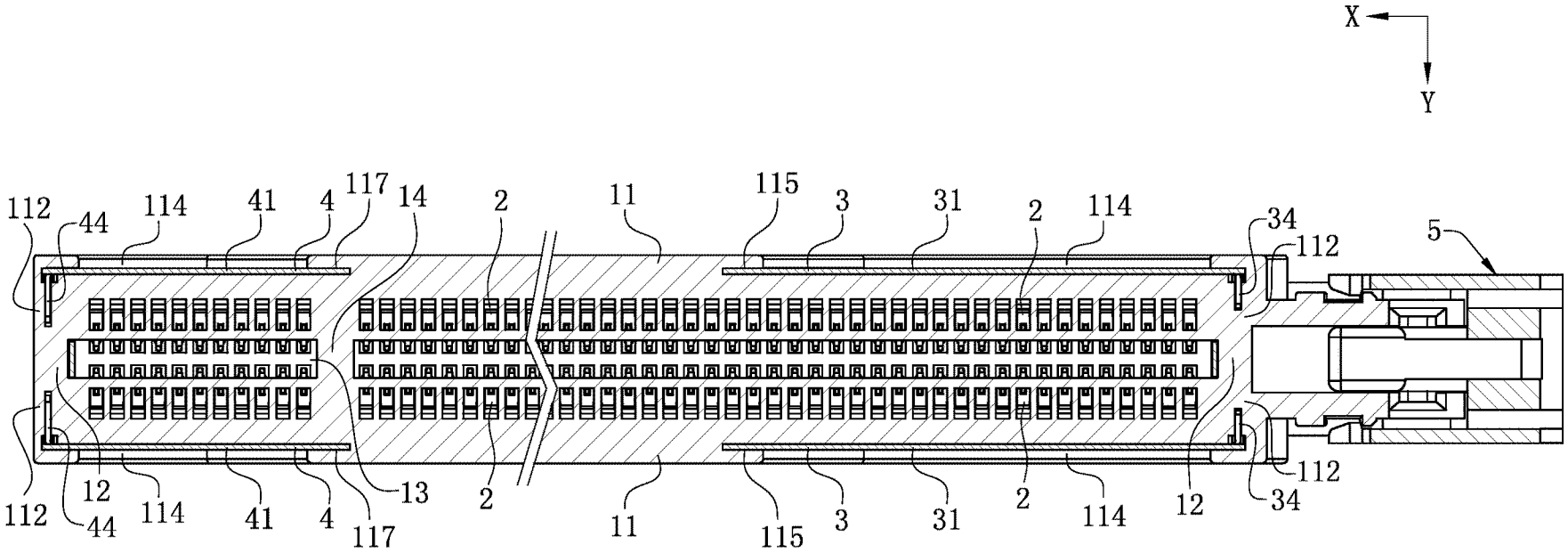
FIG. 9 is a sectional view of the electrical connector in FIG. 6 along the C-C direction.

As shown in FIG. 2, FIG. 6 and FIG. 9, the accommodating slot 117 runs downward through the first surface 1161, the second surface 1162 and the third surface 1163, and does not run downward through the corresponding side wall 11, and the accommodating slot 117 does not run outward through the corresponding side wall 11. The accommodating slot 117 runs backward through a portion of the corresponding end portion 112 along the X direction, and is in communication with the corresponding embedded slot 113. A bottom surface of the accommodating slot 117 is flush with a bottom surface of the receiving slot 115.

As shown in FIG. 1, FIG. 2 and FIG. 7, the terminals 2 are correspondingly accommodated in the terminal holes 111 and protrude into the insertion slot 13 to mate with the mating component 200. The terminals 2 being provided on each of the side walls 11 are arranged in a row along the X direction (referring to FIG. 2 and FIG. 9), and the terminals 2 are soldered to the electrical component 300.

As shown in FIG. 2 and FIG. 3, the metal member 3 includes two main body portion 31, multiple through slots 32, and a connecting portion 33 connecting the two main body portions 31.

Figure 5:
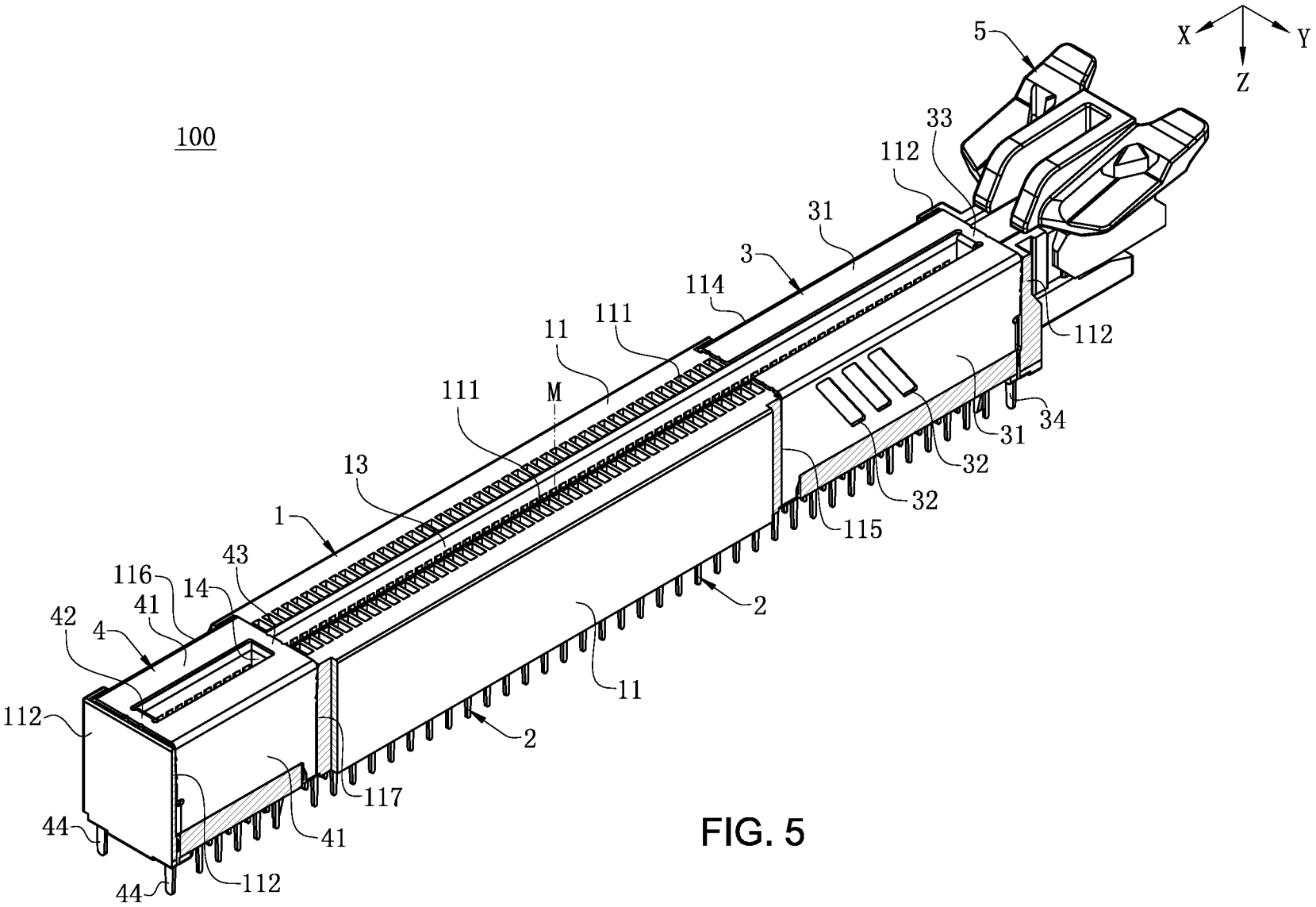
FIG. 5 is a perspective assembled view of the electrical connector in FIG. 4.

As shown in FIG. 1, FIG. 4 and FIG. 5, each of the main body portions 31 covers an outer side of the corresponding side wall 11 opposite to the inner side thereof, and is correspondingly accommodated in the concave slot 114 and the receiving slot 115 (referring to FIG. 5). Each main body portion 31 and an inner wall of the receiving slot 115 are in interference fit. A rear end of each main body portion 31 and one of the end portions 112 of the corresponding side wall 11 are in interference fit, and the corresponding side wall 11 covers a portion of each main body portion 31. In other embodiments, when the body 1 is provided with the concave slot 114 and the receiving slot 115 on only one of the side walls 11, the metal member 3 has only one main body portion 31, and the main body portion 31 is fixed to the corresponding side wall 11.

As shown in FIG. 1, FIG. 2 and FIG. 3, the metal member 3 is provided with three through slots 32 corresponding to each of the main body portions 31. The through slots 32 run through the corresponding main body portion 31 in the Y direction. Each of the through slots 32 is exposed in the concave slot 114 and is provided obliquely relative to the Z direction. The surface of the corresponding side wall 11 does not enter the through slots 32 (referring to FIG. 4 and FIG. 5). The three through slots 32 are located between the key portion 14 and the retainer 5 in the X direction. Specifically, the three through slots 32 are located between the virtual center line M and the retainer 5 in the X direction. The three through slots 32 are located closer to the retainer 5 relative to the virtual center line M, and the three through slots 32 being provided on the same main body portion 31 are arranged in one row in the X direction and located at a same height (referring to FIG. 6). One of the end walls 12 is located between the three through slots 32 and the retainer 5 in the X direction (referring to FIG. 4 and FIG. 5). Each of the through slots 32 is provided obliquely in the X-axis direction. An extending length of each of the through slots 32 in the X direction crosses over five of the terminals 2 being successively arranged, and a lower end of each of the side walls 11 is located farther away from the through slots 32 than an upper end of each of the side walls 11 (referring to FIG. 6 and FIG. 10). In other embodiments, the metal member 3 may be provided with only one through slot 32 corresponding to each of the side walls 11.

As shown in FIG. 2, FIG. 3 and FIG. 10, each of the through slots 32 has two first edges 321 parallel to each other and a second edge 322 and a third edge 323 connecting the two first edges 321. The first edges 321 are provided obliquely relative to the Z direction, and are parallel to the first wall 1141. The second edge 322 is located above the third edge 323, and is parallel to the third edge 323. The second edge 322 is perpendicular to the Z direction. The second edge 322 is located closer to the reinforcing member 4 and farther away from the retainer 5 relative to the third edge 323.

As shown in FIG. 1 and FIG. 2, the connecting portion 33 connects the two main body portions 31 in the Y direction and covers a top surface of one of the end walls 12 (referring to FIG. 4 and FIG. 5). In other embodiments, it is also possible that the metal member 3 is not provided with the connecting portion 33. That is, the two main body portions 31 are two separate structures.

As shown in FIG. 2, FIG. 3 and FIG. 8, the metal member 3 further includes a mounting leg 34 formed by bending inward from the rear end of each of the main body portions 31 and then extending downward. The mounting leg 34 is accommodated in one of the embedded slots 113 of the corresponding side wall 11, and extends downward beyond one of the end portions 112 of the corresponding side wall 11. The mounting leg 34 is located between the three through slots 32 and the retainer 5 in the X direction (referring to FIG. 6 and FIG. 10), and the mounting leg 34 is soldered to the electrical component 300.

As shown in FIG. 2 and FIG. 3, the reinforcing member 4 is made of a metal material, and is a separate structure from the metal member 3. The reinforcing member 4 includes two base bodies 41 and a connection portion 42 and a beam 43 connecting the two base bodies 41.

As shown in FIG. 1, FIG. 4 and FIG. 5, each base body 41 covers the outer side of the corresponding side wall 11 opposite to the inner side thereof, and is correspondingly accommodated in the recess 116 and the accommodating slot 117 (referring to FIG. 4 and FIG. 5). Each base body 41 and an inner wall of the accommodating slot 117 are in interference fit. A front end of each base body 41 and the other of the end portions 112 of the corresponding side wall 11 are in interference fit, and the corresponding side wall 11 covers a portion of each base body 41. In other embodiments, when the body 1 is provided with the recess 116 and the accommodating slot 117 on only one of the side walls 11, the metal member 3 has only one base body 41, and the base body 41 is fixed to the corresponding side wall 11.

As shown in FIG. 1, FIG. 2 and FIG. 3, the connection portion 42 connects the two base bodies 41 in the Y direction and covers a top surface of the other of the end walls 12, and the beam 43 connects the two base bodies 41 in the Y direction and covers a top surface of the key portion 14 (referring to FIG. 5). In other embodiments, it is also possible that the metal member 3 is not provided with the connection portion 42 and the beam 43. That is, the two base bodies 41 are two separate structures.

As shown in FIG. 1, FIG. 4 and FIG. 5, the reinforcing member 4 further includes a fixing leg 44 formed by bending inward from the front end of each of the base bodies 41 and then extending downward. The fixing leg 44 and the mounting leg 34 have identical structures. The fixing leg 44 is accommodated in the other of the embedded slots 113 of the corresponding side wall 11, and extends downward beyond the other of the end portions 112 of the corresponding side wall 11. The fixing leg 44 is soldered to the electrical component 300.

In other embodiments, the electrical connector 100 may be provided with one or more of the through slots 32 corresponding to each of the base bodies 41. Alternatively, in other embodiments, the electrical connector 100 may be provided with only one of the metal member 3 and the reinforcing member 4.

FIGS. 11-14 show an electrical connector 100 according to a second embodiment of the present invention. In this embodiment, the structures of the components as shown in the drawings being labeled with the identical numerals to those in the first embodiments are not hereinafter elaborated. The embodiment is different from the electrical connector 100 according to the first embodiment in that:

In this embodiment, the second wall 1142 is provided obliquely relative to the Z direction. The metal member 3 is provided with six through slots 32 corresponding to each of the main body portions 31 (referring to FIG. 12). A tail end of the insertion slot 13 along the X direction has an inner wall 131, and the inner wall 131 connects the two side walls 11 along the Y direction. The six through slots 32 are located between the virtual center line M and the inner wall 131 in the X direction, and along the X direction, a distance between each of the through slots 32 and the inner wall 131 is less than a distance between each of the through slots 32 and the virtual center line M (referring to FIG. 11 and FIG. 13). An extending length of each of the through slots 32 in the X direction crosses over two of the terminals 2 being successively arranged (referring to FIG. 14). The first edges 321 are provided obliquely relative to the first wall 1141, and are parallel to the second wall 1142. An upper end of each of the first edges 321 is located closer to the retainer 5 relative to a lower end of each of the first edges 321 in the X direction (referring to FIG. 13 and FIG. 14). The second edge 322 is located closer to the retainer 5 relative to the third edge 323. In other embodiments, the second edge 322 may be provided to be located farther away from the retainer 5 relative to the third edge 323. The receiving slot 115 and the accommodating slot 117 are in communication with each other in the X direction, and the metal member 3 and the reinforcing member 4 are integrally provided.

To sum up, the electrical connector according to certain embodiments of the present invention has the following beneficial effects:

(1) In comparison with the structures of the through slots 32 commonly used in the industry, i.e., the structures of the through slots 32 provided in parallel to or perpendicular to the Z direction, and with the premise that the quantity and area of the through slots 32 are the same, the through slots 32 being provided obliquely may effectively reduce the length of the through slots 32 parallel to or perpendicular to the Z direction, such that the metal member 3 maintains a stronger strength and does not easily deform, facilitating the metal member 3 to be provided on the body 1. Further, since the through slots 32 are provided obliquely, in the process of heat dissipating through the oblique through slots 32, the flow disturbing effect may easily occur, and the heat is diffused outward, such that the heat dissipation speed and flow rate significantly increase, facilitating timely heat dissipation and ensuring the normal use of the electrical connector 100.

(2) The heat generated by the electrical connector 100 during usage is mainly concentrated in the locations near the retainer 5. The through slots 32 are provided at the locations near the retainer 5, and with the premise that the strength of the metal member 3 is ensured, it is possible to timely dissipate the heat in a directed manner.

(3) The two first edges 321 are in parallel to each other and are provided obliquely relative to the Z direction, thus effectively reducing the length of each of the two first edges 321 parallel to or perpendicular to the Z direction, such that the metal member 3 maintains a stronger strength. Further, in the process of heat dissipating through the two oblique first edges 321, the flow disturbing effect may easily occur, and the heat is diffused outward, such that the heat dissipation speed and flow rate significantly increase.

(4) The first wall 1141 and the first edges 321 are in parallel to each other, and the first edges 321 are provided obliquely relative to the Z direction, such that in the process of heat dissipating through the oblique first wall 1141, the flow disturbing effect may further occur, and the heat is diffused outward, such that the heat dissipation speed and flow rate further significantly increase.

(5) The receiving slot 115 runs downward through the first wall 1141, the second wall 1142 and the third wall 1143 respectively, and does not run outward through the corresponding side wall 11. The metal member 3 is accommodated in the receiving slot 115 and is in interference fit with the receiving slot 115, such that the corresponding side wall 11 covers a front end, a rear end and a bottom portion of the metal member 3, thus reliably fixing the metal member 3 to the body 1.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to mate with a mating component, the electrical connector comprising:

a body, having an insertion slot and two side walls located at two opposite sides of the insertion slot, wherein the insertion slot is configured for the mating component to insert therein along a mating direction, and the two side walls extend along an elongated direction perpendicular to the mating direction;

a retainer, provided at one end of the body along the elongated direction, and configured to buckle with the mating component;

a plurality of terminals, provided on the two side walls and protruding into the insertion slot to mate with the mating component; and a metal member, provided on the body and correspondingly covering one of the side walls, wherein the metal member is provided with at least one through slot provided obliquely relative to the mating direction and adjacent to the retainer in the elongated direction;

wherein each of the at least one through slot has two first edges opposite to each other and a second edge connecting the two first edges, the two first edges are in parallel to each other, each of the two first edges is provided obliquely, the two first edges and the second edge are located on a same plane, and the second edge is in parallel to the elongated direction.

2. The electrical connector according to claim 1, wherein the insertion slot is concavely provided on a top surface of the body, the mating direction is a downward direction, and an upper end of each of the first edges is located closer to the retainer in the elongated direction relative to a lower end of the same first edge.

3. The electrical connector according to claim 2, wherein a lower end of each of the side walls is located farther away from the at least one through slot than an upper end of each of the side walls.

4. The electrical connector according to claim 1, wherein the terminals being provided on each of the side walls are arranged in a row along the elongated direction, and an extending length of each of the at least one through slot in the elongated direction crosses over at least two of the terminals being successively arranged.

5. The electrical connector according to claim 1, wherein the body is provided with a key portion connecting the two side walls along a lateral direction perpendicular to the mating direction and the elongated direction, and the metal member is provided with at least three through slots located between the retainer and the key portion in the elongated direction.

6. The electrical connector according to claim 1, wherein the metal member is provided with at least two through slots, the body further has an end wall, the end wall is connected to an end of each of the two side walls along the elongated direction and is located closer to the retainer in the elongated direction relative to the at least two through slots, the metal member comprises two main body portions opposite to each other and a connecting portion connecting the two main body portions, the two main body portions respectively cover the two side walls, the connecting portion correspondingly covers the end wall, and each of the main body portions is provided with at least one of the at least two through slots.

7. The electrical connector according to claim 1, wherein the through slot is provided obliquely on a plane defined altogether by the mating direction and the elongated direction.

8. An electrical connector, configured to mate with a mating component, the electrical connector comprising:

a body, having a top surface, an insertion slot extending along an elongated direction and downward concavely provided on the top surface thereof, and two side walls located at two opposite sides of the insertion slot, wherein the insertion slot is configured for the mating component to insert downward therein, the insertion slot defines a virtual center line extending along a vertical direction, and the two side walls extend along the elongated direction;

only one retainer, provided at one end of the body along the elongated direction, and configured to buckle with the mating component;

a plurality of terminals, provided on the body and protruding into the insertion slot to mate with the mating component; and a metal member, provided on the body and correspondingly covering a corresponding one of the side walls, wherein the metal member is provided with at least one through slot provided obliquely in the elongated direction and adjacent to the retainer relative to the virtual center line;

wherein the metal member has a mounting leg extending downward and pass beyond the corresponding one of the side walls to be soldered to a circuit board, the corresponding one of the side walls has an embedded slot running downward therethrough, the embedded slot does not run through the corresponding one of the side walls along a lateral direction perpendicular to the vertical direction and the elongated direction, the mounting leg is accommodated in and passing downward through the embedded slot of the corresponding one of the side walls, and the mounting leg is located between the at least one through slot and the retainer in the elongated direction.

9. The electrical connector according to claim 8, wherein each of the at least one through slot has a first edge being provided obliquely, and an upper end of the first edge is located closer to the retainer in the elongated direction relative to a lower end of the first edge.

10. The electrical connector according to claim 8, wherein the terminals are respectively provided on the two side walls, the terminals being provided on each of the side walls are arranged in a row along the elongated direction, and an extending length of each of the at least one through slot in the elongated direction crosses over at least two of the terminals being successively arranged.

11. The electrical connector according to claim 8, wherein the metal member is provided with at least three through slots located between the virtual center line and the retainer in the elongated direction.

12. The electrical connector according to claim 8, wherein a tail end of the insertion slot along the elongated direction has an inner wall connecting the two side walls, the at least one through slot is located between the virtual center line and the inner wall in the elongated direction, and along the elongated direction, a distance between one of the at least one through slot and the inner wall is less than a distance between the one of the at least one through slot and the virtual center line.

13. The electrical connector according to claim 8, wherein a lower end of each of the side walls is located farther away from the at least one through slot than an upper end of each of the side walls.

14. The electrical connector according to claim 8, wherein the body comprises a concave slot and a receiving slot downward concavely provided on a top surface of the corresponding one of the side walls, the concave slot runs outward through the corresponding one of the side walls, the concave slot has a first wall, a second wall, and a third wall connecting the first wall and the second wall, the receiving slot runs through the first wall, the second wall and the third wall respectively, the receiving slot does not run outward through the corresponding one of the side walls, the metal member is accommodated in the receiving slot and fixed and matched with the receiving slot, and the at least one through slot is exposed to the concave slot.

15. The electrical connector according to claim 8, further comprising a reinforcing member provided on the body, wherein the body is provided with a key portion connecting the two side walls along the lateral direction, and the reinforcing member covers a top surface of the key portion.

16. The electrical connector according to claim 15, wherein the body further comprises two end portions respectively connected to two elongated ends of the two side walls, the reinforcing member is fixed and matched with one of the two end portions, and the metal member is fixed and matched with the other of the two end portions.

17. The electrical connector according to claim 8, wherein the through slot is provided obliquely on a plane defined altogether by a mating direction and the elongated direction, and the insertion slot is configured for the mating component to insert therein along the mating direction.

18. An electrical connector, configured to mate with a mating component, the electrical connector comprising:

an insulating body, having two side walls opposite to each other and an insertion slot formed between inner sides of the two side walls, wherein the insertion slot is concavely provided on a top surface of the insulating body, the insertion slot is configured for the mating component to insert therein along a mating direction, the mating direction is a downward direction, and the insertion slot extends along an elongated direction perpendicular to the mating direction;

a plurality of terminals, provided on the two side walls and protruding into the insertion slot to mate with the mating component;

a metal member, provided on the insulating body and at least covering an outer side of one of the side walls, wherein the outer side and the inner side of each of the side walls are opposite to each other, the metal member is provided with a through slot to dissipate heat, the through slot is provided obliquely relative to the mating direction, the through slot has a first edge being provided obliquely, and a surface of each of the side walls does not enter the through slot; and a reinforcing member, wherein the insulating body is provided with a key portion connecting the two side walls along a lateral direction perpendicular to the mating direction and the elongated direction, a lower end of the first edge is located closer to the key portion in the elongated direction relative to an upper end of the first edge, and the reinforcing member covers the outer sides of the two side walls and covers a top surface of the key portion.

19. The electrical connector according to claim 18, wherein the insertion slot defines a virtual center line in parallel to the mating direction, the two side walls extend along the elongated direction, a tail end of the insertion slot along the elongated direction has an inner wall connecting the two side walls, the through slot is located between the virtual center line and the inner wall in the elongated direction, and along the elongated direction, a distance between the through slot and the inner wall is less than a distance between the through slot and the virtual center line.

20. The electrical connector according to claim 18, wherein the through slot is provided obliquely on a plane defined altogether by the mating direction and the elongated direction.

* * * * *